US005802100A

United States Patent [19]

Pine et al.

[11] Patent Number: 5,802,100

[45] Date of Patent: Sep. 1, 1998

[54] AUDIO PLAYBACK UNIT AND METHOD OF PROVIDING INFORMATION PERTAINING TO AN AUTOMOBILE FOR SALE TO PROSPECTIVE PURCHASERS

[76] Inventors: Marmon Pine, 9029 Sherry La., Des Plaines, Ill. 60016; Donald S. Pine, 5813 N. 47th Ave., Glendale, Ariz. 85301

[21] Appl. No.: 387,491

[22] Filed: Feb. 9, 1995

[51] Int. Cl.[6] ..... G10L 5/02

[52] U.S. Cl. ..... 395/279; 434/373; 369/27

[58] Field of Search ..... 395/2.79; 434/373; 369/27; 379/88, 71, 67

[56] References Cited

U.S. PATENT DOCUMENTS

| | | | |
|---|---|---|---|
| 2,288,683 | 7/1942 | Clancy | 434/373 |
| 3,949,420 | 4/1976 | Older | 360/72.3 |
| 3,983,550 | 9/1976 | Goss et al. | 360/12 |
| 4,016,540 | 4/1977 | Hyatt | 395/2.67 |
| 4,142,216 | 2/1979 | Goss et al. | 360/72.1 |
| 4,224,644 | 9/1980 | Lewis et al. | 360/72.2 |
| 4,636,174 | 1/1987 | Andersen et al. | 434/335 |
| 4,763,356 | 8/1988 | Day, Jr. et al. | 379/368 |
| 4,779,080 | 10/1988 | Coughlin et al. | 345/157 |
| 5,030,101 | 7/1991 | Ikemoto et al. | 434/157 |
| 5,065,345 | 11/1991 | Knowles et al. | 395/154 |
| 5,199,108 | 3/1993 | Morgan et al. | 455/18 |
| 5,237,157 | 8/1993 | Laplan | 235/375 |
| 5,293,358 | 3/1994 | Krause | 369/2 |
| 5,301,172 | 4/1994 | Richards et al. | 369/32 |
| 5,359,698 | 10/1994 | Goldberg et al. | 395/2.1 |
| 5,414,758 | 5/1995 | Kuok | 379/88 |
| 5,504,675 | 4/1996 | Cragun et al. | 364/401 |
| 5,511,000 | 4/1996 | Kaloi et al. | 364/514 |

*Primary Examiner*—Krista M. Zele
*Assistant Examiner*—Daniel S. Hunter
*Attorney, Agent, or Firm*—Brinks Hofer Gilson & Lione

[57] ABSTRACT

The present invention discloses an audio playback unit and method for assembling and providing information pertaining to an automobile for sale to prospective purchasers. Both non-replaceable and replaceable memories are utilized to provide the information. An automated method selects and organizes speech elements, which may originate either in the non-replaceable or replaceable memory, to be spoken by the playback unit.

13 Claims, 9 Drawing Sheets

Microfiche Appendix Included
(3 Microfiche, 199 Pages)

TO FIG. 2B
TO FIG. 2A
TO FIG. 2C
12V
Q4
IRFD9121
Q3
2N4401
R26
R15
R14
R17
R16
C23
C28
U15
LM1877N-9
R27
8 OHM
C29
14
40
BIAS
C19
C20
R24
R25
C27
R10
R11
R12
R13
R18
R19
C24
3-5,
10-12
42
U11
TLC2471I
C10
C11
C16
GND
OUT+
OUT-
PWRD
VDD
IN+
IN-
VOL
5V
R9
R8
X2
3.07Mhz
C14
C15
OSC1
OSC2
N0
N1
ADD1
ADD2
ADD4
ADD8
ROMCLK
RDIN
D/A1
D/A2
U10
TSP53C30
PA7
PA6
PA5
PA4
PA3
PA2
PA1
PA0
ENA1
ENA2
R/W
IRT
RDY
INIT
D0
D1
D2
D3
D4
D5
D6
D7
38
34
35

U9
74HC138
A
B
C
G1
G2A
G2B
Y0
Y1
Y2
Y3
Y4
Y5
Y6
Y7
SPEECH EN
SW LTCH
SW RST EN
A13
A14
A15
PSEN
RST

FIGURE 6

36

External Memory

| |
|---|
| ... |
| 565 |
| 563 |
| 566 |
| 1 |
| ... <> |
| with bucket seats |
| ... |

Table

| | |
|---|---|
| ... | ... |
| 562 | 4C13 |
| 563 | A78B |
| 564 | O77D |
| 565 | 8113 |
| 566 | 04C2 |
| 567 | 33BF |
| ... | ... |

30

Internal Memory

| Address | Data |
|---|---|
| ... | ... |
| 04C2 | Camaro |
| 04C3 | Firebird |
| ... | ... |
| 8113 | Red |
| 8114 | Green |
| ... | ... |
| A78A | 1966 |
| A78B | 1967 |
| ... | ... |

32

Internal RAM Memory

| Ad | Data |
|---|---|
| | ... |
| | Red |
| | 1967 |
| | Camaro |
| | with bucket seats |
| | |
| | ... |

AUDIO PLAYBACK UNIT AND METHOD OF PROVIDING INFORMATION PERTAINING TO AN AUTOMOBILE FOR SALE TO PROSPECTIVE PURCHASERS

A portion of the disclosure of this patent document contains material which is subject to copyright protection. The copyright owner has no objection to the facsimile reproduction by anyone of the patent document or patent disclosure, as it appears in the Patent and Trademark Office patent file or records, but otherwise reserves all copyright rights whatsoever.

Attached herewith as a Microfiche Appendix is a Microfiche of 196 pages of the computer program listings of the present invention. The Microfiche Appendix contains 3 frames.

BACKGROUND OF THE INVENTION

The present invention relates to a method and apparatus for collecting, organizing and transmitting information and more particularly, for providing information pertaining to an automobile for sale to prospective purchasers.

For most people, an automobile is one of the largest single purchases they will make. In order to choose the right automobile, however, the prospective purchaser must obtain information on the automobile being sold. Information pertaining to previously driven or used automobiles, such as miles previously driven, will vary even for similar model automobiles manufactured in the same year. The varying information makes the automobile for sale more or less attractive to the prospective purchaser and determines the automobile value. In most cases, to obtain this information a prospective purchaser must visit an automobile dealership and ask the salesperson specific questions pertaining to the automobile for sale.

A visit to an automobile dealership can be a tension-filled activity for the prospective purchaser. Prospective purchasers tend to distrust automobile salespeople. Much of the distrust emanates from warnings, sometimes from consumer advocate groups, which warn shoppers that the sales pitch or message pertaining to the automobile may change depending on the gender, race, age, etc. of the purchaser.

Smart automobile dealers exploit this fact by advertising that their dealership uses a low-pressure shopping environment. Shoppers can view automobiles at the dealership and ask questions without encountering a pushy salesperson. This is also known as "hassle-free looking." The salesperson will not initiate contact unless requested by the prospective purchaser. In fact, some dealers provide the prospective purchaser with a pin which says "I am just looking", promising that as long as they wear the pin, they will not be approached by a salesperson. Other dealers claim that they do not employ salespeople, only information specialists.

This approach seems to fit the times. Unfortunately, in the matter of automobiles, information on the specifics of a particular car is just not available without asking a salesperson. It is also not readily available outside of normal business hours. In fact, a prospective purchaser wandering a used car lot may have questions on many cars of interest.

A dealer may spend hundreds of dollars per car trying to answer some of these questions through conventional advertising. Further, print and broadcast media, complimented by direct mail, attempt to attract buyers with leading details of particular cars.

SUMMARY OF THE INVENTION

An audio playback unit and method for assembling and providing information pertaining to an automobile for sale to prospective purchasers is disclosed. The playback unit is tamperproof, weatherproof and theftproof, allowing it to survive the environment of the automobile dealer. It is also portable, allowing it to be placed in an automobile for sale, and easy for any prospective purchaser to use. The prospective purchaser activates the playback unit by depressing a button located on the control panel which is attached to a window of the automobile. Once activated, the playback unit transmits, through a speaker located on the control panel, a message to the prospective purchaser pertaining to the automobile for sale.

The message transmitted by the playback unit can be easily and reliably changed by the automobile dealer. Changing the message merely requires the dealer to remove a replaceable memory from the playback unit and insert into the playback unit a new replaceable memory containing a message pertaining to a second automobile. Due to the portable nature of the playback unit, a dealer can place the playback unit in the second automobile once the first automobile is sold. Once activated, the playback unit will transmit the message pertaining to the second automobile.

The replaceable memories can be programmed with new information at a service center. In order to program the new message into the replaceable memory, an automobile dealer transmits information pertaining to an automobile to be sold to the service center. The service center operator converts the received information into new message information. The operator downloads the new message information into the new replaceable memory and transfers the new replaceable memory back to the dealer. The dealer places the new replaceable memory into the playback unit and places the playback unit into the automobile for sale. A prospective purchaser can hear the new message pertaining to that automobile by activating a switch on the control panel.

Along with the message pertaining to the automobile for sale, a dealer can direct the service center to add additional information to transmit to a prospective purchaser. Therefore, a dealer can advertise to prospective purchasers their dealership, any special offers, or even sell the available advertising space.

The present invention further utilizes an automated method to select and organize speech elements whereby information to be spoken by the playback unit may originate either in the replaceable memory or in non-replaceable memory located in the playback unit.

Other advantages and benefits of the present invention will become known to the artisan through study of the following descriptions, the attached drawings, the instructions found in the Appendix, and the definitions and claims which follow.

BRIEF DESCRIPTION OF THE DRAWINGS

Preferred embodiments of the invention are explained below with references to the accompanying drawings in which:

FIG. 6 illustrates a representation of the internal and external memory storage devices according to the present invention.

DETAILED DESCRIPTION OF THE PREFERRED EMBODIMENT

Figure 1:
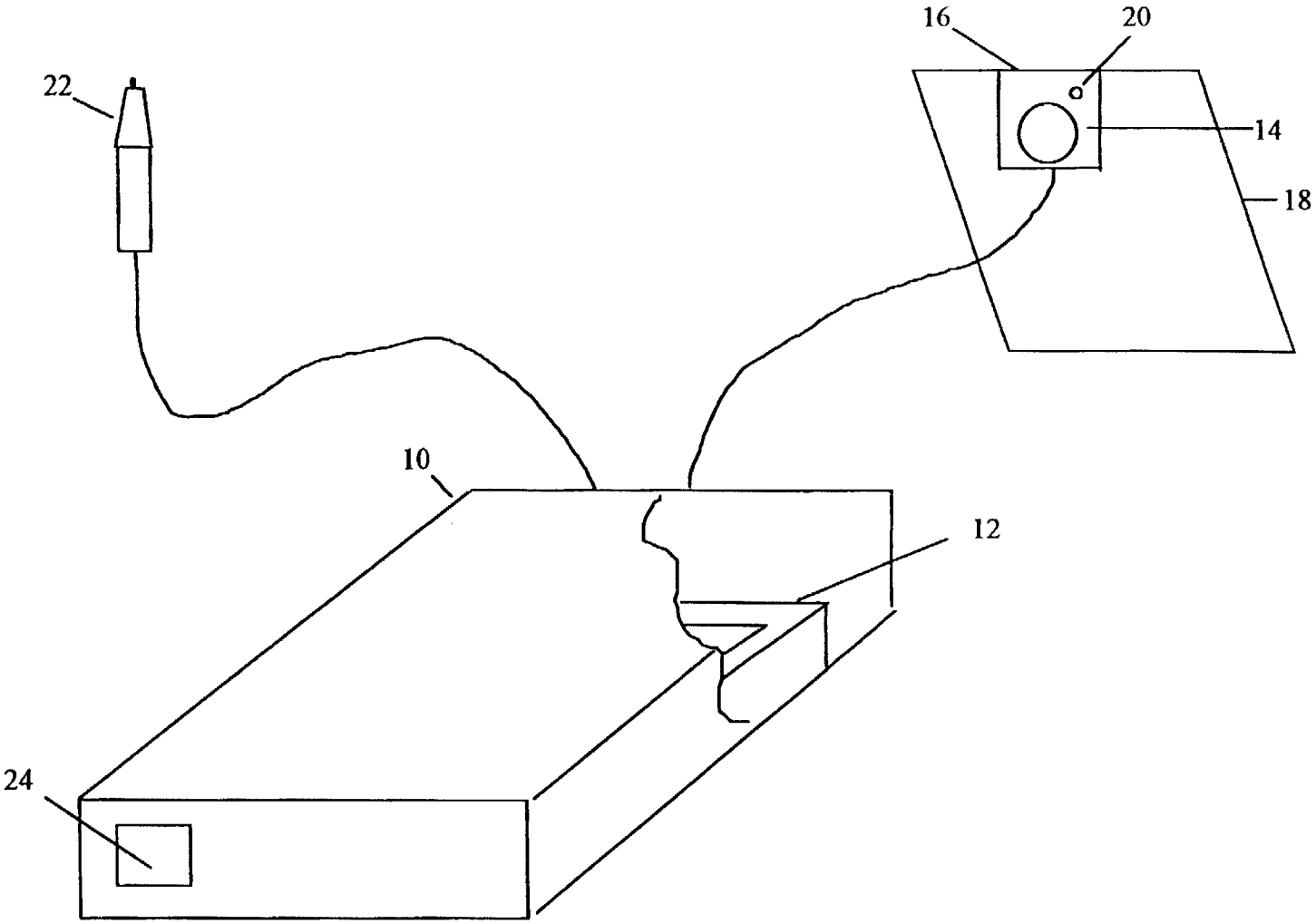
FIGS. 1 illustrates the preferred embodiment of the audio playback unit according to the present invention.
Figure 2A:
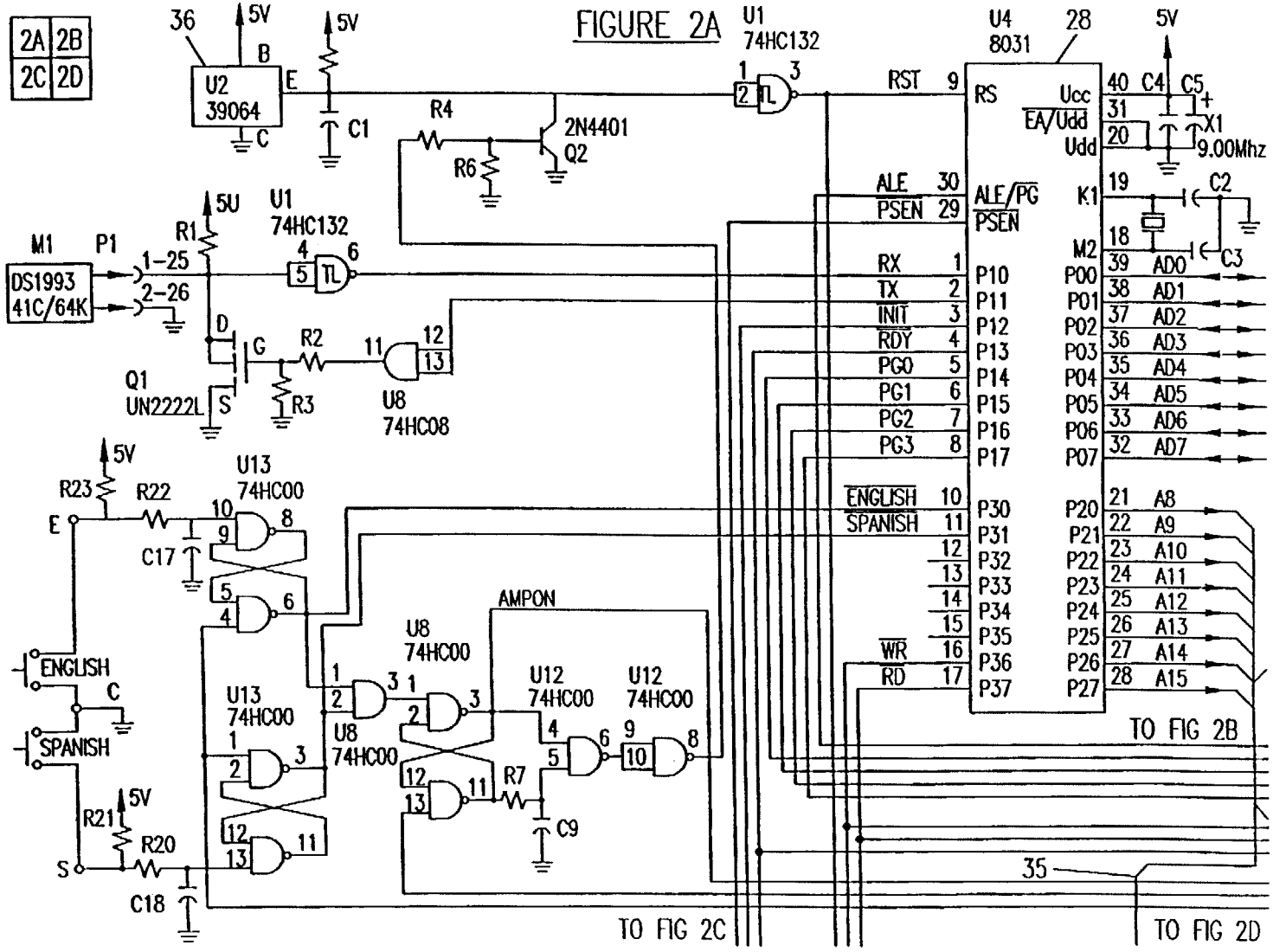
FIGS. 2A, 2B, 2C and 2D illustrate a schematic of the audio playback unit according to the present invention.
Figure 2B:
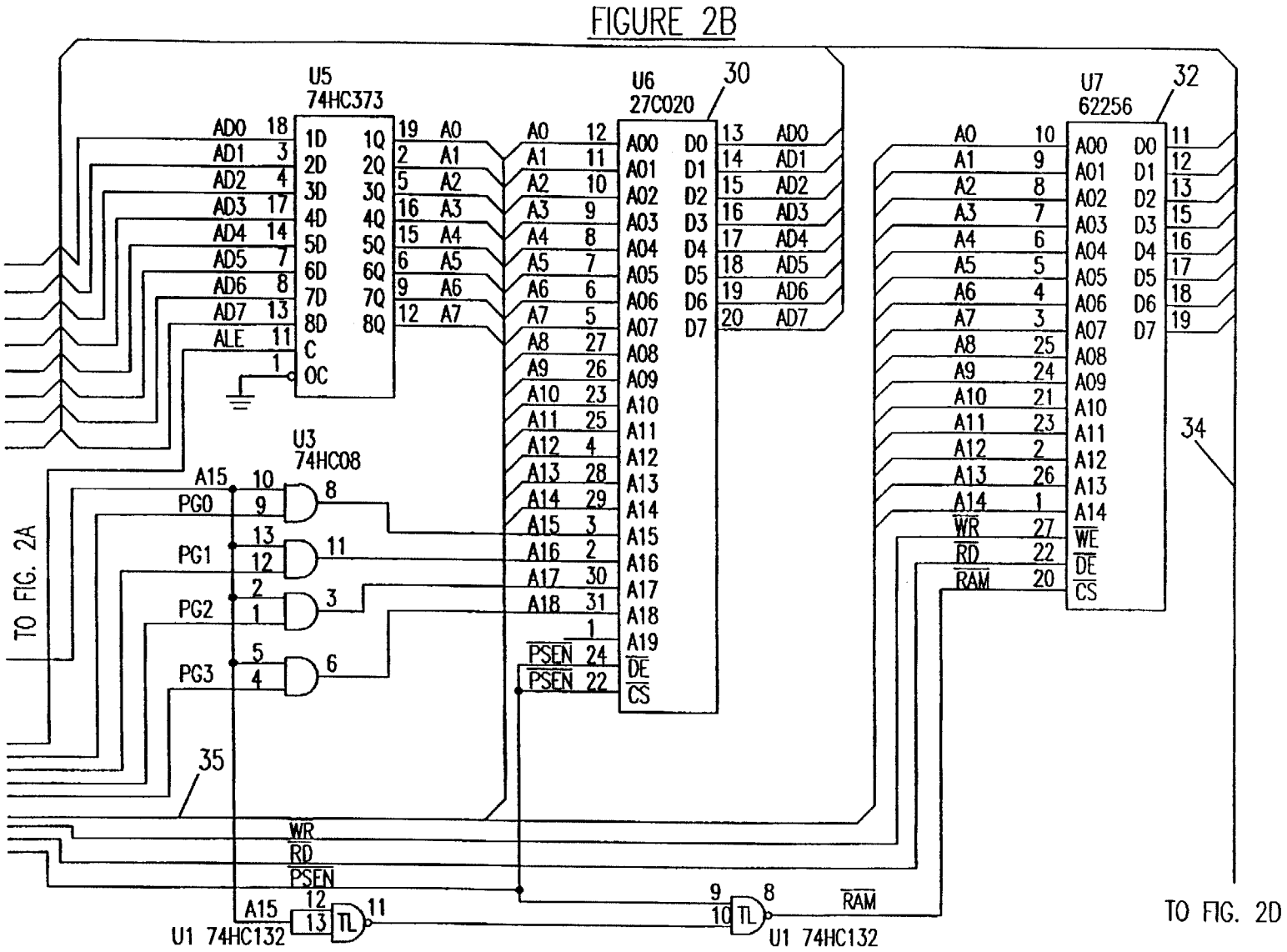
Figure 2C:
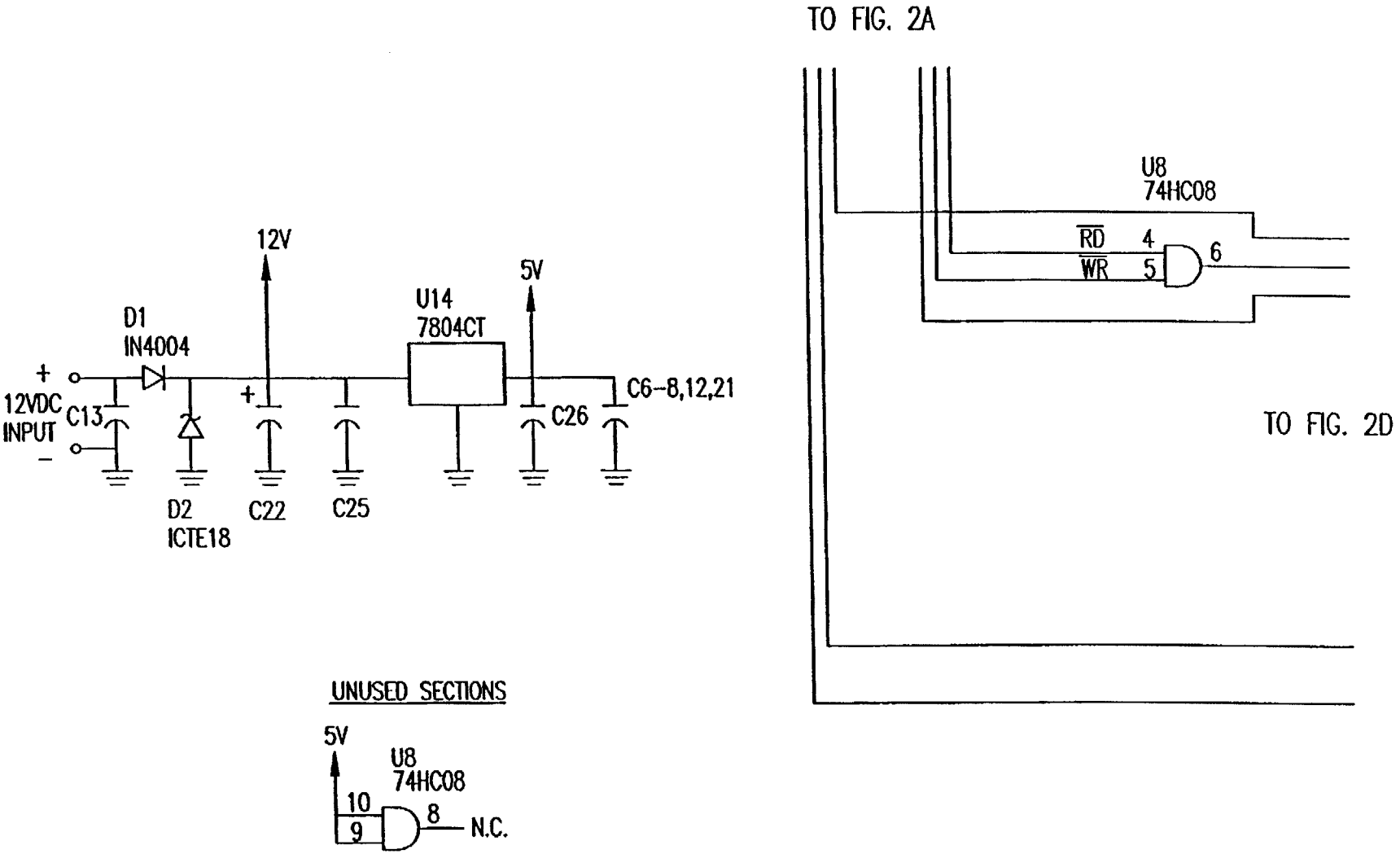
Figure 2D:
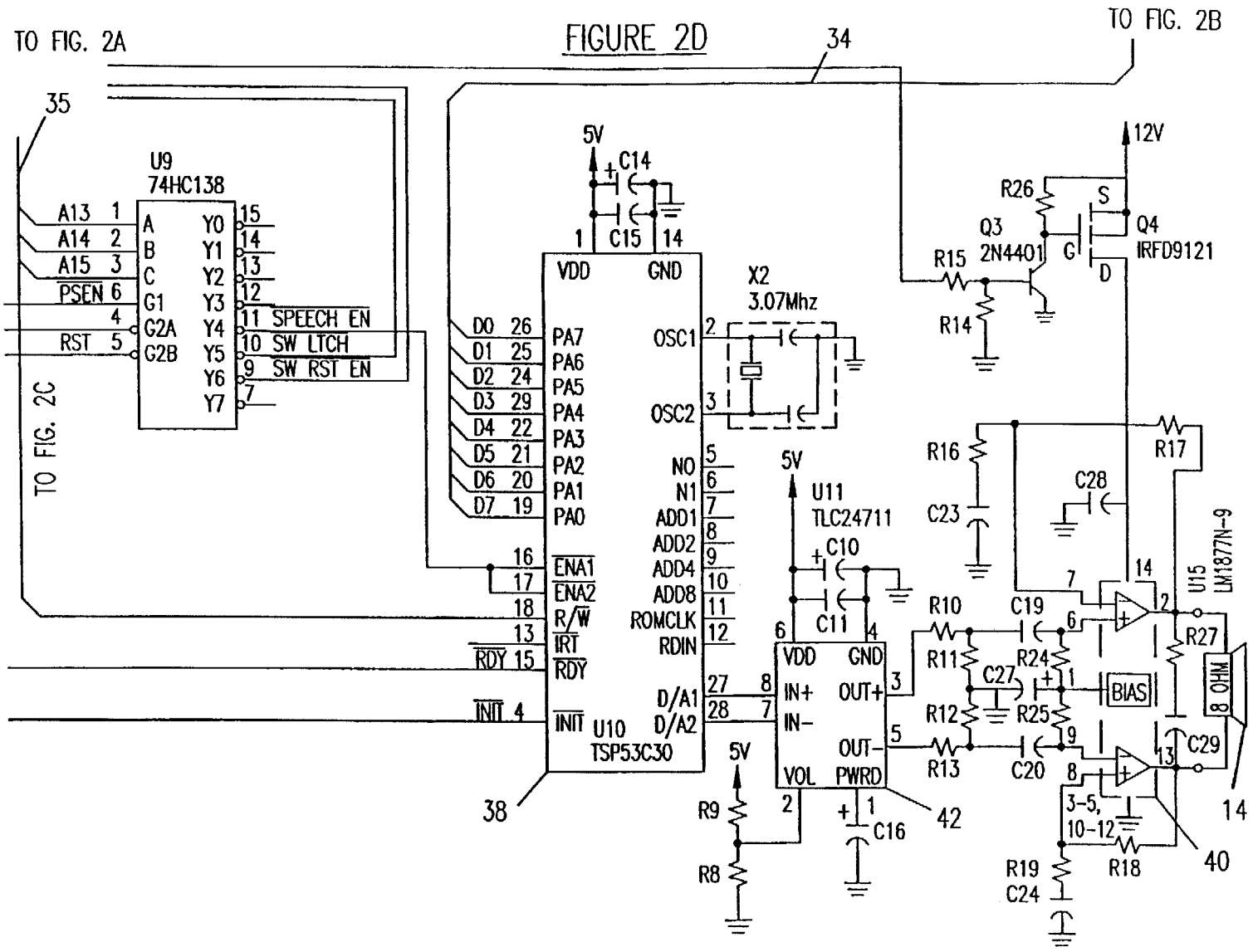

FIG. 1 illustrates an audio playback unit 10 according to a prefer red embodiment of the present invention. The playback unit 10 is used to transmit information pertaining to an automobile to be sold to prospective purchasers. The playback unit is placed in an automobile to be sold, the transmitted information pertains to that automobile for sale.

The playback unit 10 includes a printed circuit board 12 which controls the message to be transmitted. The playback unit 10 transmits the message through a speaker 14 attached to a control panel 16 when the control or switch 20, also attached to the control panel 16, is activated. While the playback unit is placed inside the automobile, the control panel 16 is placed on the automobile window 18 such that the control 20 and speaker 14 rest outside of the automobile window 18. In this manner, a prospective purchaser can control the playback unit 10 and listen to the message transmitted through the speaker without entering the automobile.

The control 20 is a single push-button switch that, when activated, will begin the audio transmission of the message pertaining to the automobile to be sold. The control 20 can also be used such that if the switch is activated during the message transmission, the program will "back up" a determined period of time, for example, ten seconds, or a predetermined number of speech elements, and begin transmitting the message from that point, a ten second review. This capability will enable the prospective purchaser to immediately review relevant information. Another use of the control panel is a switch to transmit the message in either English or Spanish.

The control panel 16 is placed on the window 18 of the automobile such that the window 18 can close tightly and keep rain and snow out of the automobile and thus protect the inside of the automobile from the elements. This aspect of protecting the inside of the automobile is especially necessary because the automobiles are washed frequently with high pressure water hoses. The speaker 14 and control 20 must be able to withstand rain, snow, wind, and water delivered at high pressure.

The playback unit is powered from the automobile battery via a power plug 22 inserted into the automobile cigarette lighter. Although using the automobile battery is the preferred embodiment, in another embodiment, the audio playback unit 10 can be powered by an internal battery (not shown).

To protect the external memory from tampering, an external memory insertion slot 24, on the front of the playback unit 10, is used for the insertion and removal of the replaceable memory. While the external memory can be inserted and removed from the external memory insertion slot 24 using an insertion tool (not shown), the prospective purchaser cannot remove the replaceable memory without the insertion device. The use of the insertion slot 24 minimizes theft and tampering of the replaceable memory.

FIGS. 2A, 2B, 2C, and 2D illustrate the electrical schematic describing the printed circuit board 12 located inside of the playback unit 10. Located on the printed circuit board 12 is a microprocessor U4 28 which controls all aspects of the audio playback unit 10. The microprocessor 28 utilized in the preferred embodiment is an Intel 8031 microprocessor. The microprocessor 28 is controlled by a microprocessor program which, along with certain data used in the program, is stored in a memory storage device. The playback routine used by the microprocessor 28, among other things, reads the replaceable memory, assembles the elements in a random access memory, and controls the transmission of the message. The microprocessor program is attached as part of Microfiche Appendix.

Also located on the printed circuit board 12 are two types of memory storage devices which are utilized by the microprocessor 28 in controlling the audio playback unit 10. The first type of memory, internal, is the main erasable programmable read-only memory (EPROM) U6 30 which contains the program to control the microprocessor 28 and also contains stored speech elements used to create the message to be transmitted to the prospective purchaser. In the preferred embodiment, the audio playback unit utilizes a 256K×8 EPROM (27C020). The internal memory also includes a random access memory U7 (RAM) 32, which is utilized by the microprocessor 28 when creating the message to be transmitted. The preferred embodiment utilizes a 32K×8 RAM (62256).

The microprocessor 28 is electrically coupled to the internal memory devices 30 and 32, and to a speech processor U10 38, through the data bus 34 (the microprocessor 28 also utilizes the data bus 34 as an address bus for certain applications). The microprocessor 28 also utilizes an address bus 35 to control the internal memory devices 30 and 32, and the speech processor 38.

Although not used in the preferred embodiment, the internal memory may also utilize one or more auxiliary memories. An auxiliary memory may be used to increase the internal memory storage space, for example, when it becomes necessary to install additional dealer specific elements or advertising, or to store elements in another language, such as Spanish.

The second type of memory is the replaceable memory or external memory M1 36. The external memory 36, which is easily inserted or removed from the playback unit 10 through the external memory insertion slot 24 using an insertion tool, contains data identifying location, in internal memory 30, of speech elements used by the microprocessor 28 when creating the message to be transmitted, or may contain the speech elements themselves. The microprocessor 28 accesses data from the external memory 36 through the microprocessor's receive RX and transmit TX ports, P10 and P11, respectively.

The preferred embodiment utilizes a Dallas Semi-Conductor Touch Memory DS 1993. The touch memory is a two-wire reusable device that is environment insensitive which is especially necessary in the automobile industry where automobiles are left outside in extreme weather. Because of its ability to read and write to memory with only a two wire connection, the "contact" problems normally created by dirt, dust and other impurities are greatly reduced. Also, problems associated with multiple insertion devices, such as connectors, are minimized due to the reduced number of connections. The touch memory is also rugged and thus impervious to handling abuses by the dealer who will, most likely, be inserting and removing the touch memories into and out of the playback unit 10. While other transportable memory devices such as floppy disks, CD ROMs, and computer memory chips, can be utilized in the present invention, these memory storage technologies are read by devices with moving parts which are expensive and not as reliable as the touch memory devices. Also, semiconductor devices and similar devices that do not require readers with moving parts, are very sensitive to handling and not designed to be transported in an application such as the present invention. The touch memory provides the best all around performance.

A speech processor 38 is also located on the printed circuit board 12. A TSP 53C30, manufactured by Texas Instruments, is used to convert digital input, concatenated by the microprocessor 28 using the internal and external memories, to an analog signal for transmission through the speaker 14. The microprocessor 28 controls the speech processor 38 via the data bus 34 and the address bus 35. The speech processor 38 outputs the signal to a filter U11 42. The signal is then transmitted through an amplifier U15 40 to amplify the analog signal prior to transmission through the speaker 14.

Other various components such as latching inverters, capacitors, transistors, regulators, crystals and resistors are utilized by the playback unit 10, their use is easily understood by a person having ordinary skill in the art and is thus not further described in this specification.

Figure 3:
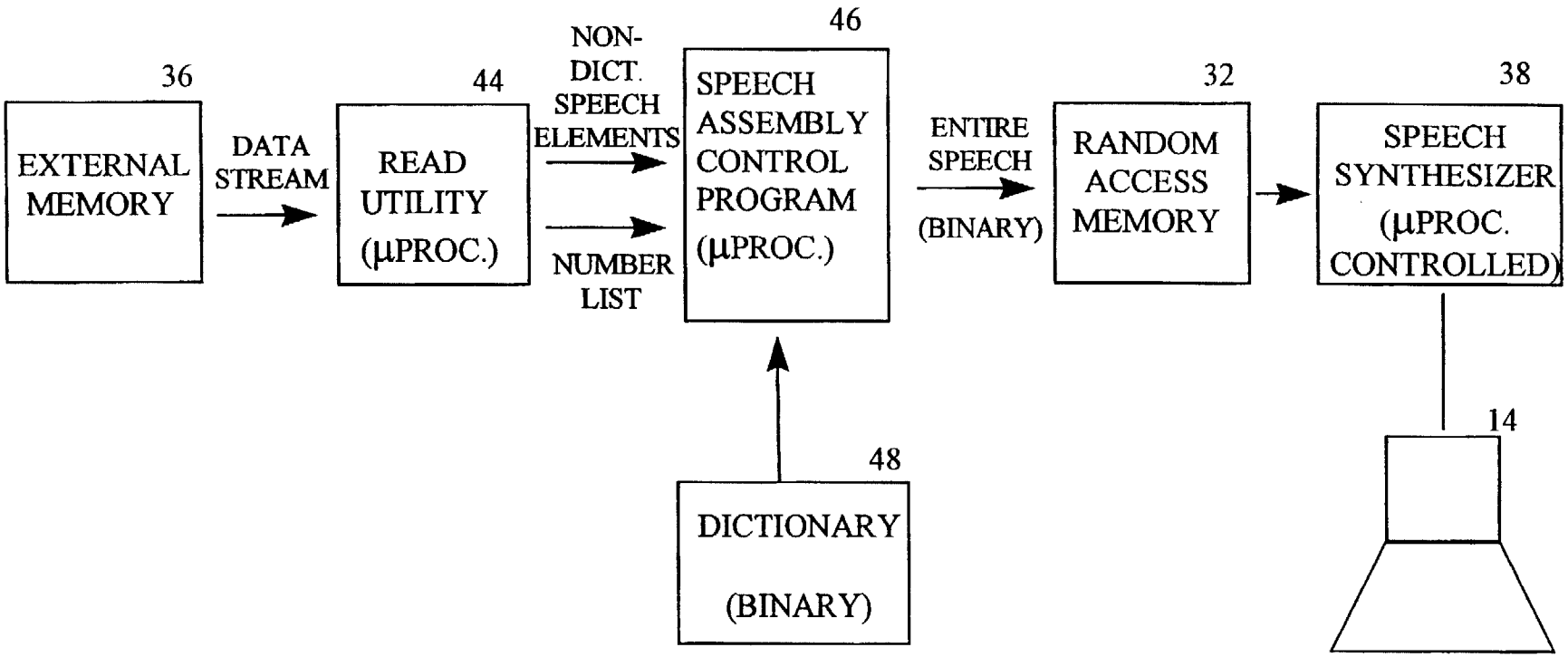
FIG. 3 illustrates a functional block diagram of the audio playback unit according to the present invention.

FIG. 3 shows the functional block diagram of the audio playback unit 10. In order for a dealer to be able use an audio playback unit 10 in an automobile he is attempting to sell, a replaceable memory 36 must be programmed for that particular automobile. The replaceable memory 36 provides information to the microprocessor 28 pertaining to which elements from the element list, located in the internal memory 30 and, in some cases, the external memory 36, will be used, and in what order. The external memory 36 download routine is described below.

Once placed in an audio playback unit 10, a read utility 44 extracts data from the external memory 36. A speech assembly control program 46 then concatenates elements from the element list or dictionary 48, residing in the internal memory 30, along with the non-dictionary elements retrieved from the external memory 36, if any, and loads the internal RAM memory 32 with the concatenated binary message. The binary message is then converted to an analog signal in the speech processor 38 before being audibly transmitted through the speaker 14 to the prospective purchaser. The microprocessor program is attached as part of Microfiche Appendix.

Figure 4:
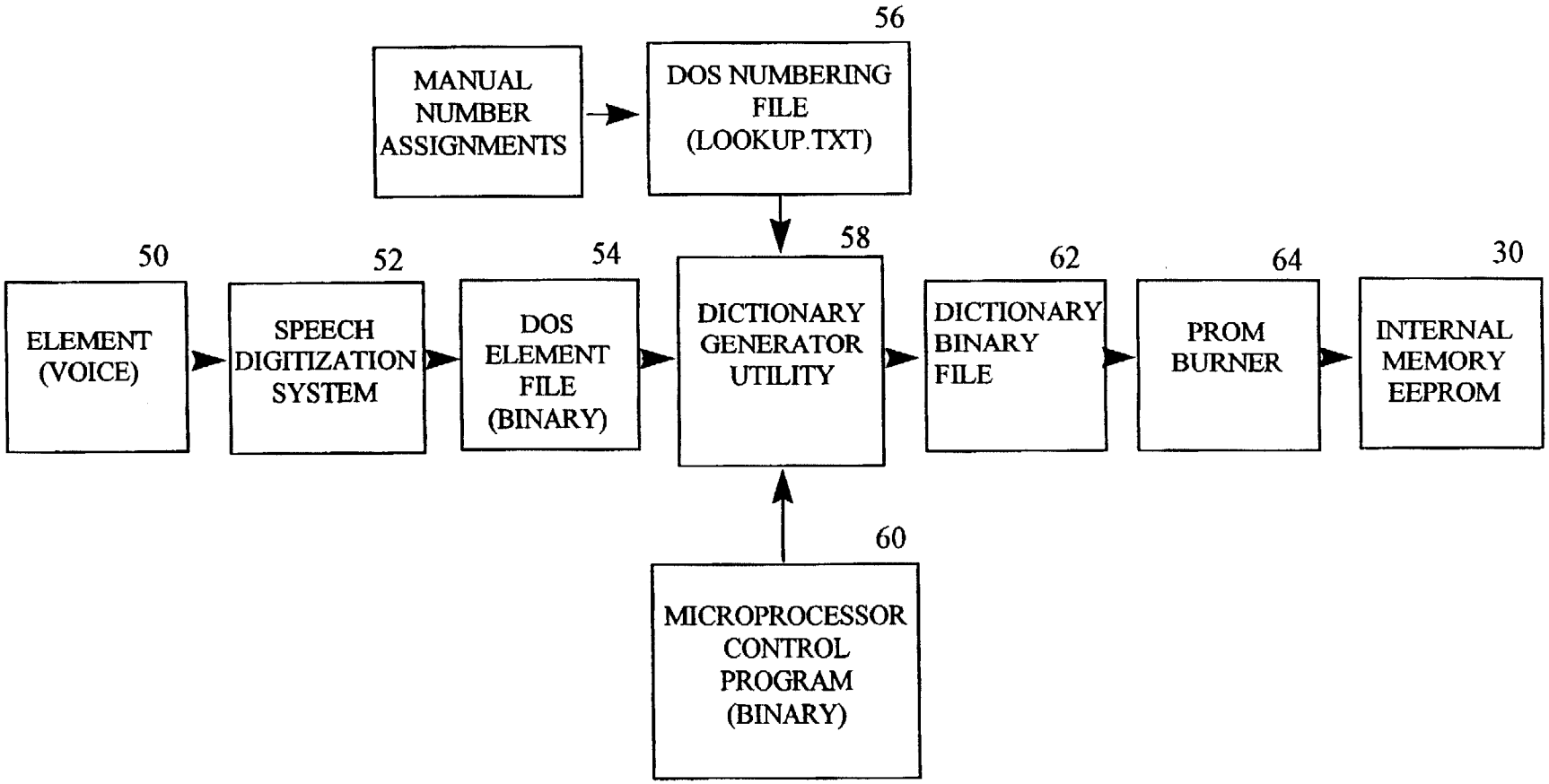
FIG. 4 illustrates a functional block diagram of the internal memory download routine according to the present invention.

The internal memory contains three separate groupings of data: the microprocessor control program (control program); the individual speech elements (elements); and the table which contains the location (or address) of the individual speech elements in the internal memory (table). The combination of the Table and the Elements is referred to as "the dictionary". FIG. 4 shows the functional block diagram of the routine which downloads these data groups into the internal memory 30. As described in detail elsewhere, these three groupings work together to create the message to be delivered to the prospect. The control program uses the table to locate the proper elements for assembly into the message. The internal memory download routines are attached as part of the Microfiche Appendix.

To create the internal memory element grouping, an element 50 (tape recorded voice) is digitized using a speech digitization system 52, the SDS 5000 manufactured by Texas Instruments, to create a DOS element file 54. The digitization process used in the preferred embodiment is Linear Predictive Coding (LPC), however, other types of speech synthesis exist. The desired speech is captured, either on high quality tape where it is transferred to an electronic system, or directly by the electronic system. In either case, the captured speech is converted into electronic codes and separated into groups of data, speech elements, which are individually stored for future analysis.

Each element file 54 is assigned an identifying tag which is recorded in the DOS numbering file (LOOKUP.TXT) 56. The dictionary generator utility 58 converts the DOS numbering file 56 into the table of locations which it then combines with the microprocessor control program 60 with the DOS element files 54 to create a dictionary binary file 62. The dictionary binary file is "burned" into the internal memory 30 using a PROM burner 64 resulting in an internal memory 30 containing a dictionary and the microprocessor control code 60.

Figure 5:
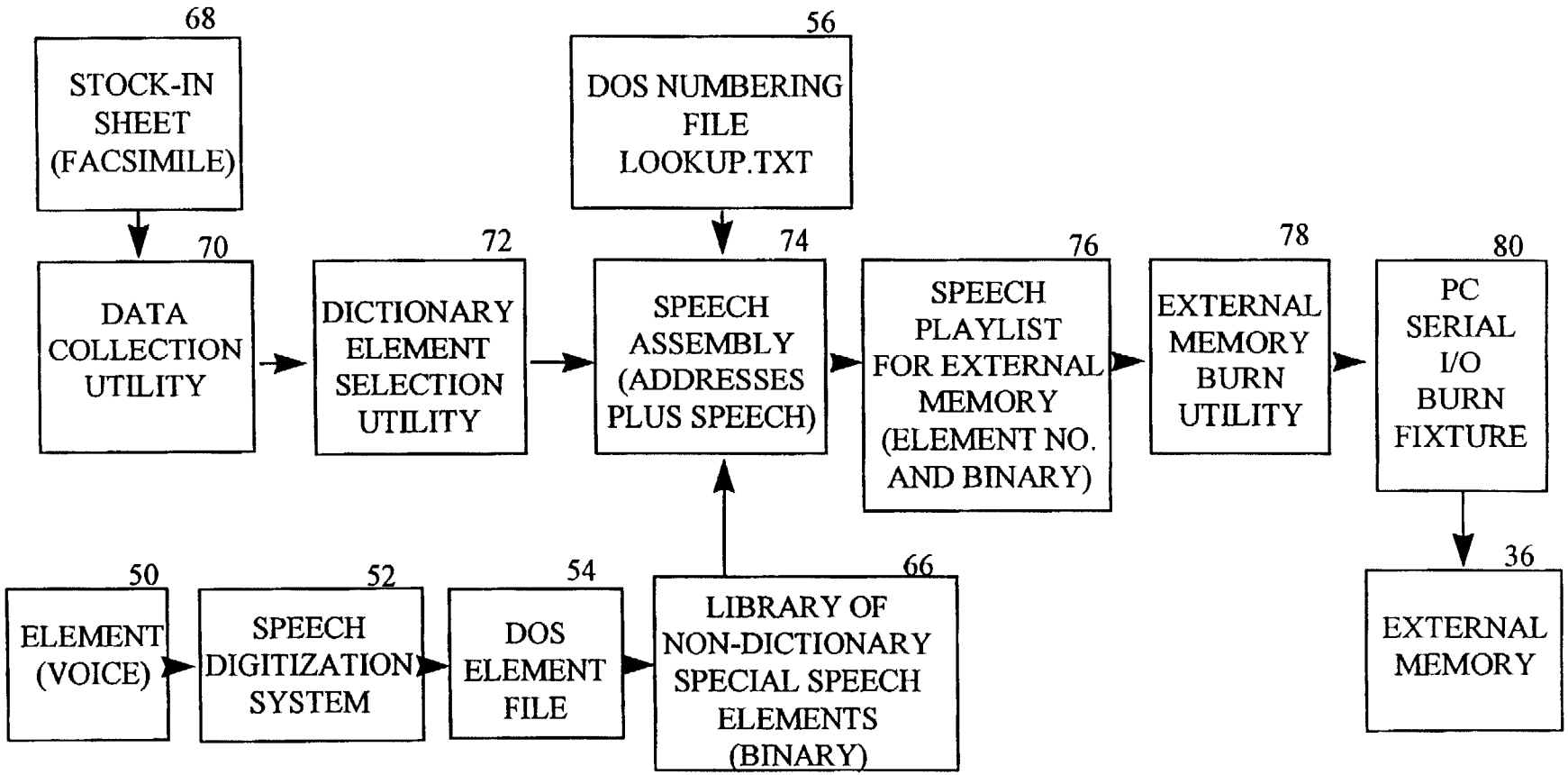
FIG. 5 illustrates a functional block diagram of the external memory download routine according to the present invention.

FIG. 5 shows the functional block diagram for programming the external memory 36. The external memory download routines are attached as part of the Microfiche Appendix. After being programmed, the external memory 36 contains information which will allow the microprocessor to select elements from the element list located in the internal memory 30. The external memory 36, however, may contain non-dictionary elements 66, or elements not previously stored in the element list in the internal memory 30. These non-dictionary elements 66 are also created using the speech digitization process described above. For example, Dealer's Names and Dealer's Special Messages may be non-dictionary elements 66.

The automobile dealer transmits information pertaining to the automobile to be sold to a service center, or somewhere where the capability exists to create replaceable memories 36. This can be accomplished by sending a facsimile transmission of the stock-in sheet 68 pertaining to the automobile for sale which is entered into a data collection utility 70 by an operator. Although a remote service center is used in the preferred embodiment of the present invention, a service center may be located at the dealership where the automobile to be sold is located.

A dictionary element selection utility program 72 operates on the data received from the data collection utility 70 using a set of conditional rules to identify the correct elements which will be selected for speech, creating element numbers. A speech assembly utility program 74, using the same DOS numbering file 56, assembles the element numbers with any non-dictionary speech elements 66 to create a speech playlist 76. An external memory burn utility program 78 then programs the external memory 36 through a pc serial burn fixture 80.

There are many ways the dealer can transmit information to the service center. The preferred embodiment, however, utilizes a facsimile transmission of the automobile's "stock-in" sheet from the dealer selling the automobile to the service center. Instead of the stock-in sheet, a survey of the necessary information can be used. In another embodiment, the dealer sends the information pertaining to the automobile to be sold to the service center via facsimile. The service center then converts the information as described above and downloads the information into the playback unit through a modem, thereby removing the need for an external memory 36.

Once the replaceable memory 36 is programmed with the data pertaining to the automobile to be sold, the replaceable memory 36 is sent to the dealer. The dealer then inserts the replaceable memory into an audio playback unit 10. The playback unit 10 is placed into the automobile to be sold and the power plug 22 is placed into the cigarette lighter. The control panel 16 is placed on the window 18 such that the speaker 14 and control 20 are exposed to any prospective purchaser. When a prospective purchaser activates the control 20, the playback unit 10 transmits the message pertaining to the automobile to be sold through the speaker 14.

As described above, the external memory 36 provides the element numbers which, when used with a table in the internal memory 30, point to an address in the internal memory 30 where the desired element resides. The element number, however, may also point to an address located, instead, in the external memory 36. The located element is transferred into the internal RAM memory 32 and the program returns to read the next element number in the external memory 36. This routine continues until each element number in the external memory 36 has been accessed and every element has been transferred into the internal RAM memory 32. The microprocessor program then transfers the elements in the internal RAM memory 32 to the speech processor 38 where the message is converted from a digital signal to an analog signal to be audibly transmitted through the speaker 14 to the prospective purchaser.

FIG. 6 represents the internal memory 30, the internal RAM memory 32, and the external memory 36. The actual data residing in each of these memories are binary digits (BITs), however, for representative purposes, alphanumeric symbols are used.

The microprocessor 28, using the microprocessor program located in the internal memory 30, reads the element number (565) from the external memory 36. The element number uses a table located in the internal memory 30 to identify a location (8113) in the internal memory 30, where the speech element (RED) is located. The speech element is then loaded sequentially into the internal RAM memory 32. For element numbers below 256, the program loads a speech element into the internal RAM memory 32 from the external memory 36. The program routine repeats this sequence until all of the element numbers have been read from the external memory 36 and all of the elements have been loaded into the internal RAM memory 32. When the internal RAM memory 32 transmits the sequentially ordered elements through the speech processor 38, the message "red 1967 Camaro with bucket seats" will be audibly transmitted to the prospective purchaser through the speaker 14.

To create a speech element to be stored in the external or internal memories, human voice is converted into 50 electronic samples per second or 20 msec samples. Each speech element is made up of at least one and usually multiple 20 msec samples. The number of samples per second determines the ability of the playback unit to recreate the human voice. Increasing the number of samples improves the quality.

The converted information is then stored in the internal and external memories to be played back as part of, or for the entire message to a prospective purchaser. The message transmitted to the prospective purchaser is made up of at least one and usually multiple speech elements. As describe above, elements stored in the internal memory 30 are stored during the manufacture of the playback unit, while elements stored in the external memory 36, if any, are stored during the programming of the external memory 36 for a particular automobile to be sold.

The algorithms and instructions disclosed, along with the mechanical and electrical arrangements are but embodiments of the invention. Other mechanical and electrical arrangements, other logical routines and subroutines are possible and are to be included in the invention and are not meant to limit the scope of the invention.

We claim:

1. An audio playback unit placed in or around an automobile for sale for providing information pertaining to said automobile for sale to prospective purchasers comprising:

a microprocessor;

a replaceable semiconductor memory containing element numbers, said memory coupled to said microprocessor;

a second semiconductor memory containing speech elements;

a speech synthesizer coupled to said microprocessor, said speech synthesizer controlled by said microprocessor;

an audible output device, said output device coupled to said speech synthesizer;

a switch, said switch coupled to said microprocessor for activating said microprocessor;

a power supply coupled to said microprocessor, said power supply providing power to said microprocessor such that when said switch is activated, said microprocessor retrieves element numbers from said replaceable memory and, depending on said element numbers, constructs a message based on said speech elements located in said second memory, and transfers said message through said output device.

2. An audio playback unit according to claim 1 wherein said automobile for sale is a used or previously driven automobile.

3. An audio playback unit according to claim 1 wherein said replaceable memory comprises a touch memory.

4. An audio playback unit according to claim 1 wherein said replaceable memory further contains speech elements.

5. An audio playback unit according to claim 1 wherein said replaceable memory resists removal from said audio playback unit except with an insertion tool.

6. An audio playback unit according to claim 1 wherein said audible output device comprises a speaker.

7. An automatic playback unit according to claim 1 wherein said audible output device comprises a transducer.

8. An automatic playback unit according to claim 1 wherein said power supply comprises an automobile battery.

9. An automatic playback unit according to claim 1 wherein said power supply comprises a solar panel.

10. A method of providing information pertaining to an automobile for sale to a prospective purchaser comprising the steps of:

obtaining data pertaining to said automobile for sale;

converting said data into element numbers;

storing said element numbers into a replaceable semiconductor memory;

placing said memory device into an audio playback unit containing a second semiconductor memory containing speech elements;

retrieving said speech elements from said second memory based on the element numbers located in the replaceable memory;

constructing a message consisting of the speech elements from said second memory based on the element numbers located in the replaceable memory; and transmitting said message to said prospective purchasers at the location of the automobile for sale.

11. The method of providing information according to claim 10 wherein said obtaining data pertaining to an automobile for sale comprises receiving information from an automobile seller pertaining said automobile for sale.

12. A method of providing information pertaining to an automobile for sale to a prospective purchaser comprising the steps of:

inserting a replaceable memory containing element numbers into an audio playback unit containing a microprocessor and a second memory containing speech elements such that when activated said microprocessor will construct a message based on the element numbers located in the replaceable memory and the speech elements located in the second memory; and placing said audio playback unit containing said replaceable memory and said second memory in or near said automobile for sale such that when activated said message will be transmitted through an output device.

13. The method of providing information according to claim 12 further comprising the step of activating a switch on said audio playback unit such that said audio playback unit will construct a message based on the element numbers located in the replaceable memory and the speech elements located in the second memory, and transmit said message to said prospective purchaser.

* * * * *